US007540181B1

(12) United States Patent
Memmott

(10) Patent No.: US 7,540,181 B1
(45) Date of Patent: Jun. 2, 2009

(54) WIRE-DRAWING DIE ASSEMBLY

(75) Inventor: Joseph M. Memmott, Provo, UT (US)

(73) Assignee: US Synthetic Corporation, Orem, UT (US)

( * ) Notice: Subject to any disclaimer, the term of this patent is extended or adjusted under 35 U.S.C. 154(b) by 0 days.

(21) Appl. No.: 11/580,817

(22) Filed: Oct. 13, 2006

(51) Int. Cl.
*B21C 3/02* (2006.01)

(52) U.S. Cl. ..... 72/467; 72/274

(58) Field of Classification Search ..... 72/274, 72/278, 478, 467, 468; 76/107.4
See application file for complete search history.

(56) References Cited

U.S. PATENT DOCUMENTS

| | | | | |
|---|---|---|---|---|
| 1,551,751 | A | 9/1925 | Kozak | |
| 1,597,927 | A * | 8/1926 | Simons | 72/465.1 |
| 3,110,625 | A | 11/1963 | Bettner | |
| 3,823,598 | A * | 7/1974 | Freeman | 72/467 |
| 4,046,103 | A | 9/1977 | Yakuboff | |
| 4,281,617 | A | 8/1981 | Bevers et al. | |
| 4,426,954 | A | 1/1984 | Keller | |
| 4,454,657 | A * | 6/1984 | Yasumi | 33/644 |
| 4,534,934 | A | 8/1985 | Cho | |
| 4,624,817 | A | 11/1986 | Gusack et al. | |
| 5,449,408 | A | 9/1995 | Koaizawa et al. | |
| 5,849,083 | A | 12/1998 | Milliman | |
| 5,851,137 | A | 12/1998 | Bhave et al. | |
| 6,314,836 | B1 | 11/2001 | Einset et al. | |
| 6,810,712 | B2 | 11/2004 | Goto | |
| 6,969,313 | B2 | 11/2005 | Sung | |
| 7,060,641 | B2 | 6/2006 | Qian et al. | |

* cited by examiner

*Primary Examiner*—Dana Ross
*Assistant Examiner*—Debra M Sullivan
(74) *Attorney, Agent, or Firm*—Workman Nydegger

(57) ABSTRACT

Various embodiments of the present invention are directed to wire-drawing die assemblies. In one embodiment, a wire-drawing die assembly includes an assembly of at least three die segments. Each of the die segments includes an inner die surface comprising a superhard material. The inner die surfaces of the die segments form a die cavity. In another embodiment, a wire-drawing die assembly includes an assembly of die segments, each of which includes an inner die surface. The inner die surfaces of the die segments form a die cavity. Each of the die segments further includes two sidewalls, with the inner die surface extending between the two sidewalls. At least a portion of each of the two sidewalls may be oriented nonparallel relative to a wire-drawing axis of the die cavity.

24 Claims, 10 Drawing Sheets

WIRE-DRAWING DIE ASSEMBLY

TECHNICAL FIELD

The present invention relates to wire-drawing dies that utilize superhard materials, such as polycrystalline diamond.

BACKGROUND

Wire-drawing dies that employ diamond as the bearing material have been available for many years. Typically, a portion of a wire-drawing die that forms a die cavity for shaping the wire is made from natural diamond. Natural diamond has commonly been used for the portion of the wire-drawing die that forms the die cavity. However, the size of the die cavity is limited by the availability of suitably-sized natural diamond pieces. Moreover, the cost of natural diamond can be prohibitively high for large die cavities.

Polycrystalline diamond has also been used for the die cavity. FIG. 1 shows a side cross-sectional view of a prior art design for a wire-drawing die 10 that utilizes polycrystalline diamond. The wire-drawing die 10 includes a polycrystalline diamond compact ("PDC") 11 formed of an inner, annular polycrystalline diamond ("PCD") region 12 that is often bonded to an outer cobalt-cemented tungsten carbide cylinder 14. The PCD region 12 also includes a die cavity 16 configured for receiving and shaping a wire being drawn. The wire-drawing die 10 is typically encased in stainless steel to allow for handling and marking. In use, a wire 18 of a diameter d, is drawn through die cavity 16 along a wire drawing axis 20 to reduce the diameter of the wire 18 to a reduced diameter $d_2$.

A variety of conventional processes may be used for fabricating the wire-drawing die 10. Typically, a hollow of the tungsten carbide cylinder 14 is packed with diamond particles. The tungsten carbide cylinder 14 and the diamond particles are subjected to an ultra-high-pressure, ultra-high-temperature ("HPHT") process that melts a portion of the cobalt from tungsten carbide cylinder 14. The melted cobalt is swept into the interstitial regions of the diamond particles from a region of the tungsten carbide cylinder 14 adjacent to the diamond particles. The melted cobalt acts as a catalyst that promotes bonding of the diamond particles to form a coherent mass of polycrystalline diamond shown as the PCD region 12 in FIG. 1. Laser drilling may be used to form a hole through the sintered polycrystalline diamond that is subsequently smoothly finished to form the die cavity 16.

Increasing the size of the die cavity 16 to allow for drawing large-diameter wire and wire bundles (e.g., over about 0.5 inch diameter) tends to result in a lower quality PCD region 12. Inefficiency of cobalt diffusion by the conventional radial sweep-through technique is believed to be one factor causing this decrease in quality for the PCD region 12. Radial diffusion may fail to provide a sufficient cobalt concentration near the center of the PCD region 12, resulting in poorly bonded diamond particles in the PCD region 12 and porosity in the PCD region 12. These defects may render the PCD region 12 unusable or may decrease the lifetime of the wire-drawing die 10. Additionally, larger, more expensive diamond presses are used to sinter larger PCD regions 12. Fabrication of large-diameter superhard dies of high quality can be therefore difficult and expensive. Manufacturers and users of wire-drawing dies continue to seek improved superhard wire-drawing dies for drawing large-diameter wires and wire bundles.

SUMMARY

Various aspects of the present invention are directed to wire-drawing die assemblies. In one aspect of the present invention, a wire-drawing die assembly includes an assembly of at least three die segments. Each of the die segments includes an inner die surface comprising a superhard material. The inner die surfaces of the die segments form a die cavity. In another aspect of the present invention, a wire-drawing die assembly includes an assembly of die segments, each of which includes an inner die surface. The inner die surfaces of the die segments form a die cavity. Each of the die segments further includes two sidewalls, with the inner die surface extending between the two sidewalls. At least a portion of each of the two sidewalls may be oriented nonparallel relative to a wire-drawing axis of the die cavity. Accordingly, seams between adjacent die segments do not score or otherwise mark a wire or wire bundle with longitudinal striations when drawn through the die cavity in contrast to die cavities in which the sidewalls of the die segments are oriented parallel to the wire-drawing axis.

DETAILED DESCRIPTION OF THE SEVERAL EMBODIMENTS

Figure 1:
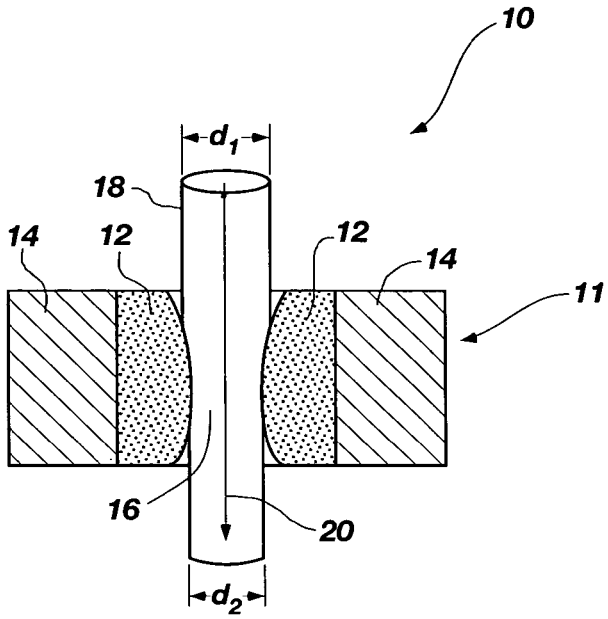
FIG. 1 (PRIOR ART)
FIG. 1 is a side cross-sectional view of a prior art design for a wire-drawing die utilizing a polycrystalline diamond compact.

Various embodiments of the present invention are directed to wire-drawing die assemblies including multiple die segments comprising a superhard material and forming a die cavity. Utilizing multiple die segments enables forming wire-drawing die assemblies of various sizes and configurations. Such a die cavity may be used for drawing large-diameter wire and wire bundles (e.g., multiple wires), such as wires or wire bundles with a diameter greater than about 0.5 inches.

The small size of the die segments enables them to be suitably fabricated utilizing conventional fabrication equipment, such as a conventional cubic or belt press.

FIGS. 2 through 4B show a wire-drawing die assembly 30 in accordance with various embodiments of the present invention. The wire-drawing die assembly 30 includes a plurality of die segments 32 that form a die cavity 34 when assembled. In some embodiments of the present invention, the wire-drawing die assembly 30 may have as few as two die segments 32. Although the wire-drawing die assembly 30 is illustrated in FIGS. 2 through 4A as having twelve die segments 32, in various other embodiments of the present invention, such as the embodiment shown in FIG. 4B, a wire-drawing die assembly may have at least three die segments 32. In other embodiments of the present invention, the wire-drawing die assembly 30 may employ three or more of the die segments 32, as desired, to form the die cavity 34 of a selected size. The die segments 32 are secured within a housing 36 by a retention member 38, which may be brazed, press-fit, or otherwise secured within the housing 36. The retention member 38 includes a passageway 40 generally aligned with the die cavity 34. The passageway 40 is defined by an inner surface 41. The passageway 40 exhibits a selected shape (e.g., a frustoconical geometry) and a cross-sectional size that may continuously decrease in a direction toward the die cavity 34. The housing 36 includes a passageway 42 that is defined by an inner surface 43. The passageway 42 exhibits a selected shape and a cross-sectional size that may decrease in a direction away from the die cavity 34. The passageway 42 is generally aligned with the die cavity 34. Accordingly, during use, a wire or wire bundle may be drawn through the passageway 40, shaped by passing through the die cavity 34, and drawn out of the passageway 42.

Figure 2:
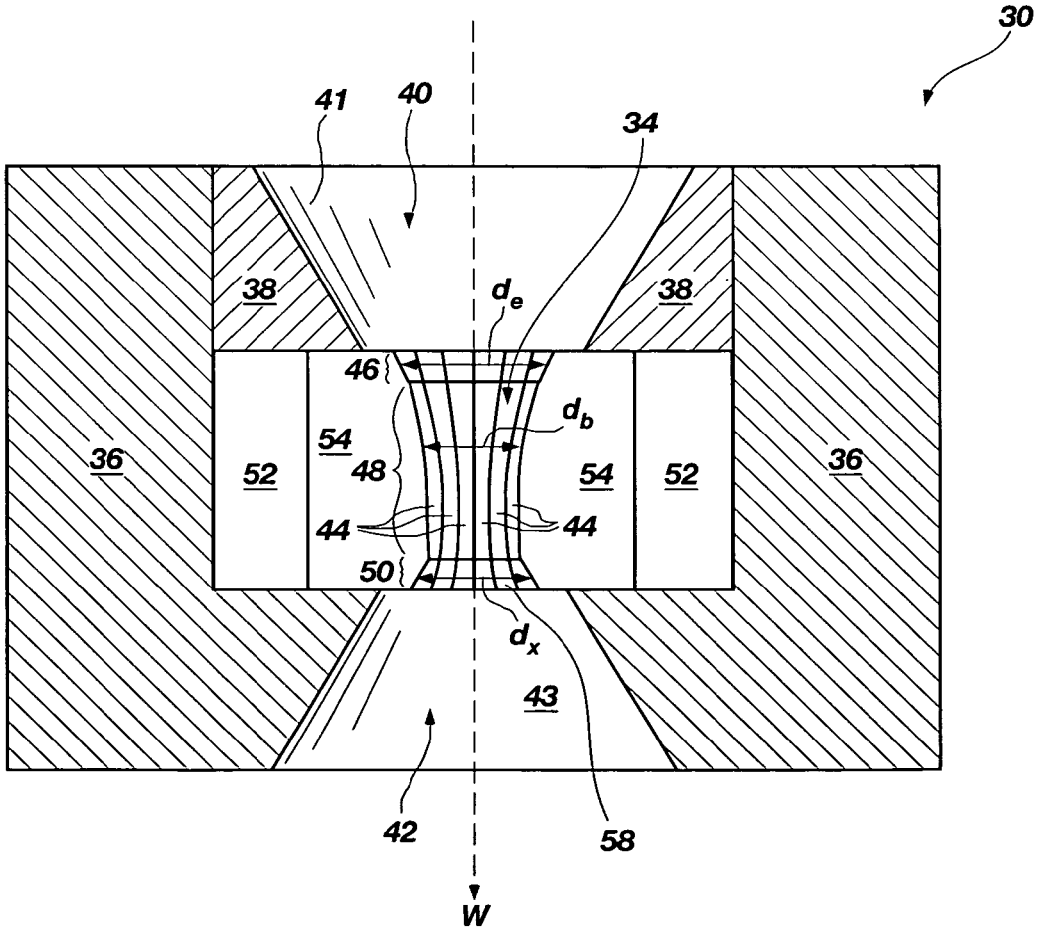
FIG. 2 is a side cross-sectional isometric view of a wire-drawing die assembly in accordance with various embodiments of the present invention.
Figure 3:
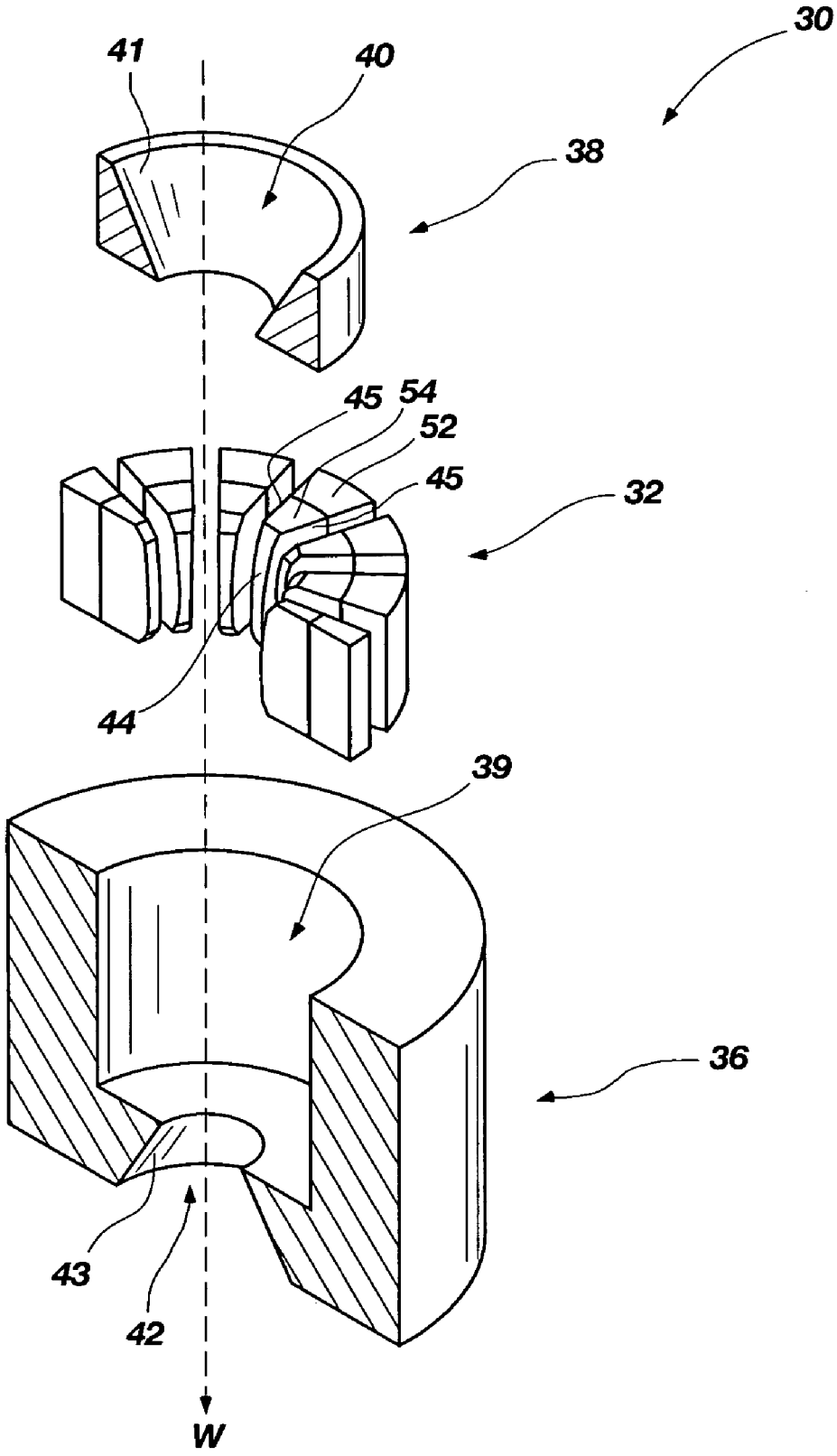
FIG. 3 is an exploded, cross-sectional isometric view of the wire-drawing die assembly shown in FIG. 2.
Figure 4A:
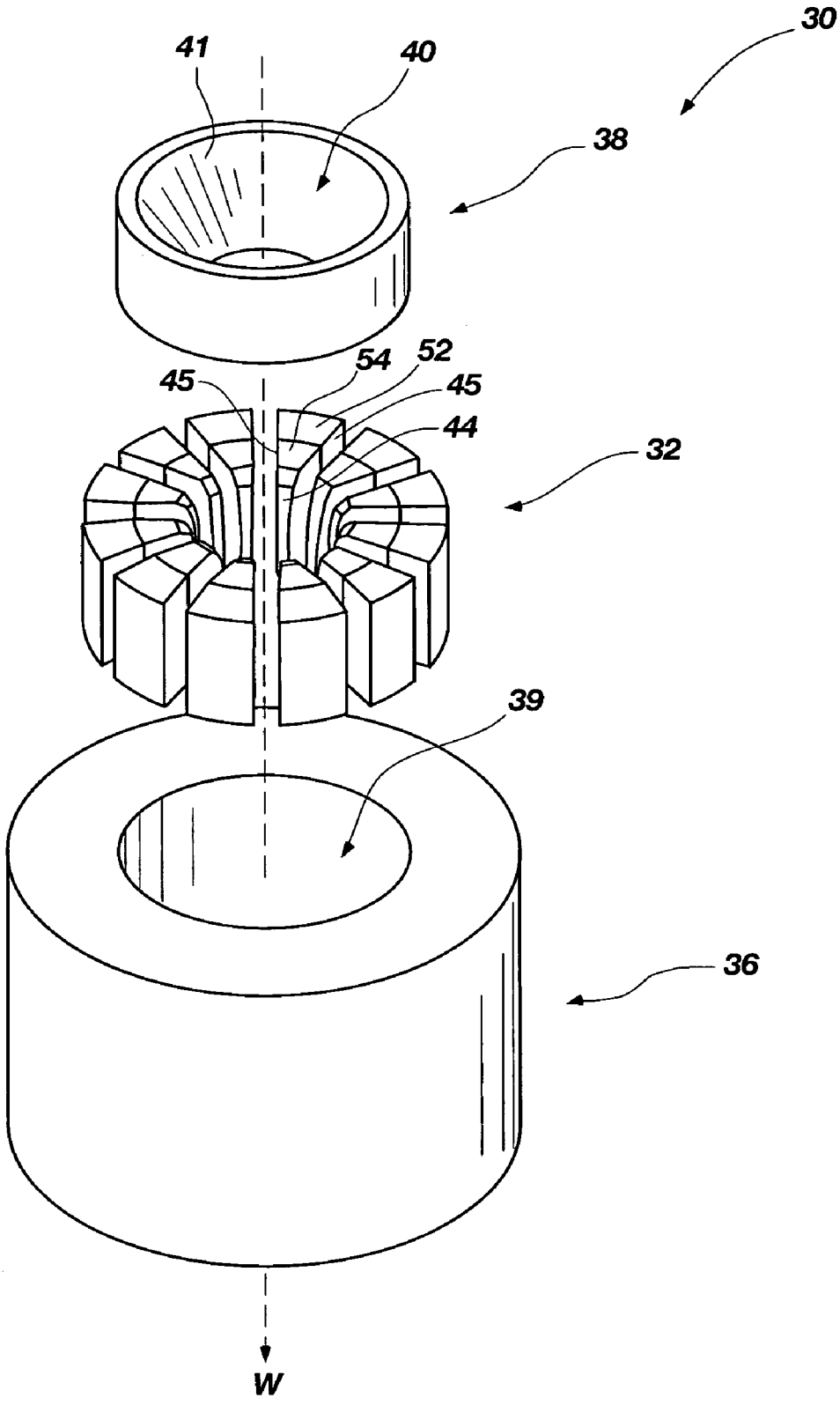
FIG. 4A is an exploded, isometric view of the wire-drawing die assembly shown in FIG. 2.
Figure 4B:
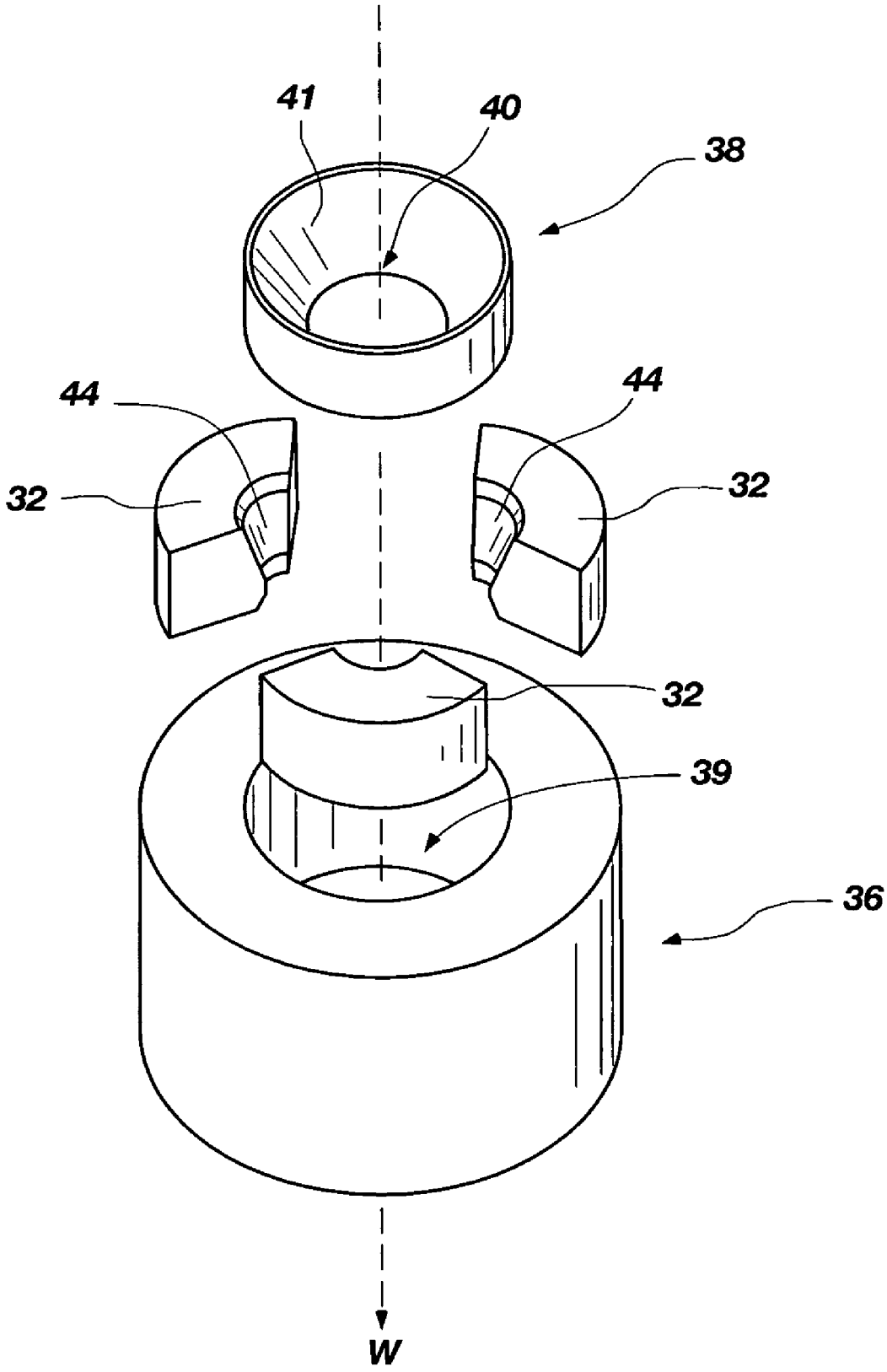
FIG. 4B is an exploded, isometric view of a wire-drawing die assembly having only three die segments in accordance with another embodiment of the present invention.

As shown in FIG. 2, the die segments 32 are positioned within a recess 39 (FIGS. 3 and 4A) of the housing 36 and distributed about a wire-drawing axis W of the die cavity 34 to form a generally hollow structure, with the die cavity 34 extending through the hollow structure. Inner die surfaces 44 of each of the die segments 32 collectively form the die cavity 34 that shapes a wire or wire bundle drawn along the wire-drawing axis W through the die cavity 34. As shown in FIGS. 3 and 4, each of the die segments 32 also includes sidewalls 45 that the inner die surface 44 extends between. When the die segments 32 are assembled, the sidewalls 45 of adjacent die segments 32 abut each other to form seams 58 (FIG. 2) between the adjacent die segments 32. Although the die cavity 34 is illustrated in FIGS. 2 through 4 as having a circular cross-sectional geometry configured to form wire or wire bundles having a circular cross-section, the die cavity 34 may also be configured to form wire or wire bundles of any cross-sectional geometry, such as a rectangular or triangular cross-sectional geometry or other desire cross-sectional geometry. The die cavity 34 may include, in certain embodiments, three sections: (1) an entrance section 46; (2) an intermediate section 48; (3) and an exit section 50. The entrance section 46 exhibits a larger diameter $d_e$ than the diameter of the wire or wire bundle to be drawn. The intermediate section 48 has a diameter $d_b$ that may continuously decrease toward the exit section 50 for reducing the diameter of the wire or wire bundle drawn through the die cavity 54. The exit section 50 has a diameter $d_x$ that continuously increases in a direction away from the intermediate section 48, which allows the wire or wire bundle shaped by the intermediate section 48 to be drawn through the die cavity 34 and through the passageway 42 formed in the housing 36 for further processing downstream, if desired.

The retention member 38 may be inserted within the recess 39 (FIGS. 3 and 4A) and secured over the assembly of the die segments 32 to retain the die segments 32 within the recess 39. For example, the retention member 38 may be press-fit with the housing 36 or secured by another suitable technique.

Figure 5:
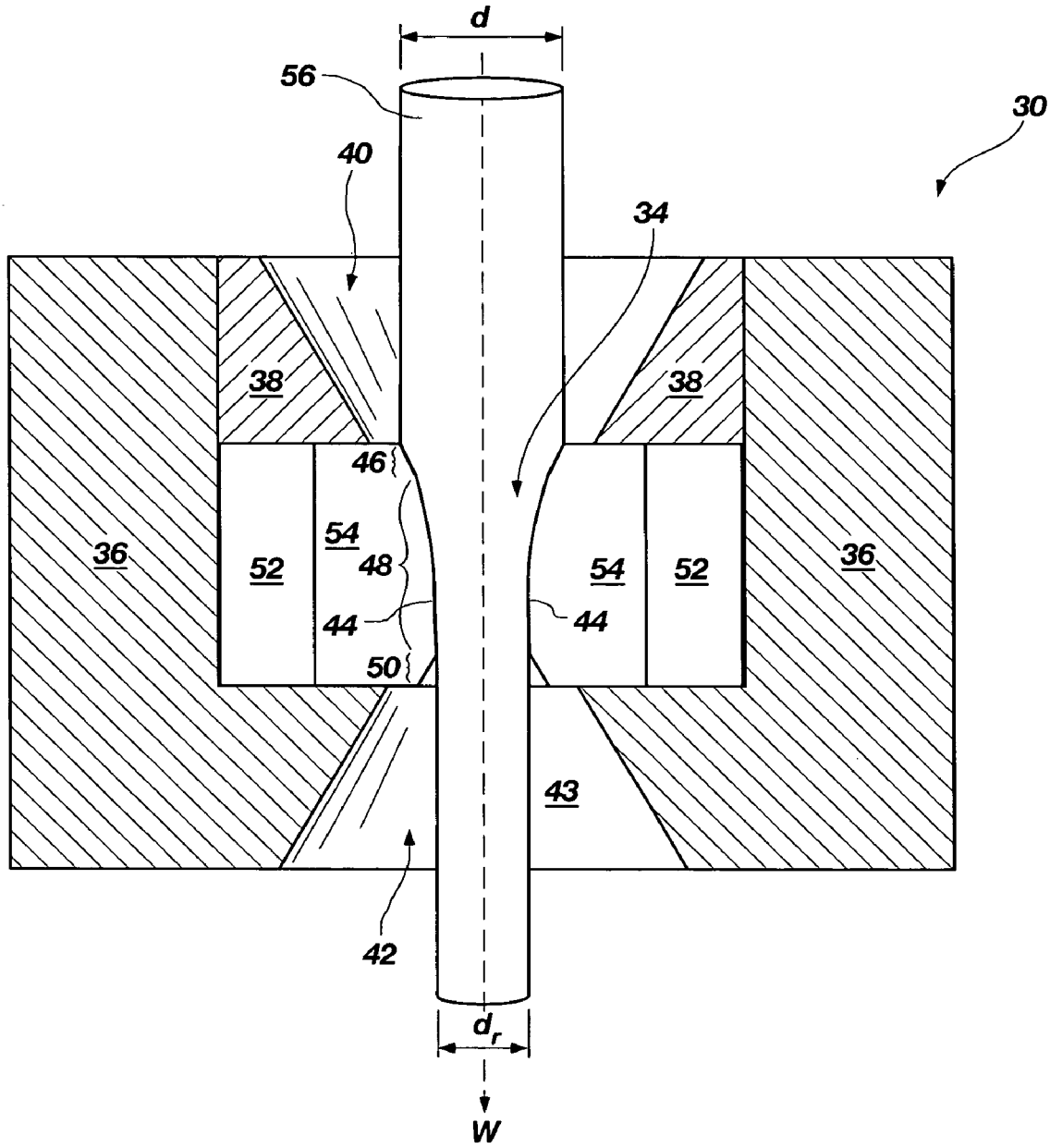
FIG. 5 illustrates a wire or wire bundle being drawn through the wire-drawing die assembly shown in FIG. 2.

In practice, the passageway 40 may be filled with a lubricant or the like to assist with drawing a wire or wire bundle through the die cavity 34. As shown in FIG. 5, a wire or wire bundle 56 of diameter d is drawn along the wire-drawing axis W of the die cavity 34 through the passageway 40 of the retention member 38. As the wire or wire bundle 56 is drawn through the die cavity 34, the contoured inner die surfaces 44 of the assembly of die segments 32 bear against the wire or wire bundle 56 to reduce the diameter of the wire or wire bundle 56 to dr. After shaping, the wire or wire bundle 56 having the reduced diameter dr exits through the passageway 42 formed in the housing 32. The wire or wire bundle 56 having the reduced diameter dr may be passed through one or more similar wire-drawing die assemblies to further reduce the diameter. In addition, another type of downstream processing may be performed, such as coiling or coating of the processed wire or wire bundle 56.

In the embodiment shown in FIGS. 2 through 4A, each of the die segments includes a substrate 52 bonded to a bearing element 54, with the inner die surface 44 extending between generally parallel sidewalls 45. The bearing elements 54 are made from a superhard material. As used herein, the term "superhard," or the phrase "superhard material," refers to any material having a hardness that is at least equal to the hardness of tungsten carbide. The substrate 52 may be, for example, a cobalt-cemented tungsten carbide substrate and the bearing element 54 may be natural diamond, polycrystalline diamond, polycrystalline cubic boron nitride, silicon carbide, or any combination of the preceding materials. In another example, a superhard material as disclosed in U.S. Pat. No. 7,060,641, the disclosure of which is incorporated herein, in its entirety, by this reference may be employed to form a superhard material used for the bearing elements 54.

In one embodiment of the present invention, the substrate 52 is cobalt-cemented tungsten carbide and the bearing element 54 is polycrystalline diamond. Such a structure may be fabricated by subjecting diamond particles, placed on or proximate to a cobalt-cemented tungsten carbide substrate, to a HPHT sintering process. The diamond particles with the cobalt-cemented tungsten carbide substrate may be HPHT sintered at a temperature of at least about 1000° Celsius (e.g., about 1100° Celsius to about 1600° Celsius) and a pressure of at least 40 kilobar (e.g., about 50 kilobar to about 70 kilobar) for a time sufficient to consolidate and form a coherent mass of bonded diamond grains. The cobalt from the cobalt-cemented tungsten carbide substrate sweeps into interstitial regions between the diamond particles to promote growth between the diamond particles. Accordingly, the die segments 32 may be cut from relatively small conventionally formed PDCs using wire-electrical-discharge machining ("wire EDM") or sintered to near net shape in a conventional diamond press using the HPHT process. In another embodiment of the present invention, a superhard material (e.g., diamond) may be deposited, using chemical vapor deposition, on a substrate that may be formed to the shape of the die segment 32 or cut to the shape of the die segment 32 after deposition of the superhard material.

In other embodiments of the present invention, the substrate 52 may be omitted, with the die segment 32 including only the bearing element 54 made from any of the superhard materials described above, including, but not limited to, cemented tungsten carbide or polycrystalline diamond. However, cemented tungsten carbide used for the bearing element 54 exhibits a relatively lower wear resistance than diamond or cubic boron nitride. For example, in the three die segment embodiment shown in FIG. 4B and two die segment embodiment shown in FIG. 7B, the die segments may be formed from only a superhard material and the substrate may be omitted.

Employing multiple die segments 32 enables the die cavity 34 to be formed to a selected dimension and/or configuration. For example, in one embodiment of the present invention, a die cavity may exhibit a cross-sectional size of greater than about 0.5 inches (e.g., greater than about 0.5 inches or greater than about 0.536 inches). When the bearing element 54 comprises polycrystalline diamond or polycrystalline cubic boron nitride, the smaller individual die segments 32 may be fabricated using the HPHT process in a cubic or belt press, without limitation. Accordingly, a press capable of forming the entire wire-drawing die assembly is not necessary because they may be cut from a small conventionally formed compact or formed to near net shape in a conventional diamond press. Additionally, forming smaller individual die segments 32 may produce fewer defects, such as porosity or other structural defects that may be more common when forming large-diameter polycrystalline diamond compacts. Fewer defects may result in a longer operational lifetime and higher production yields for the wire-drawing die assembly 30.

Figure 6:
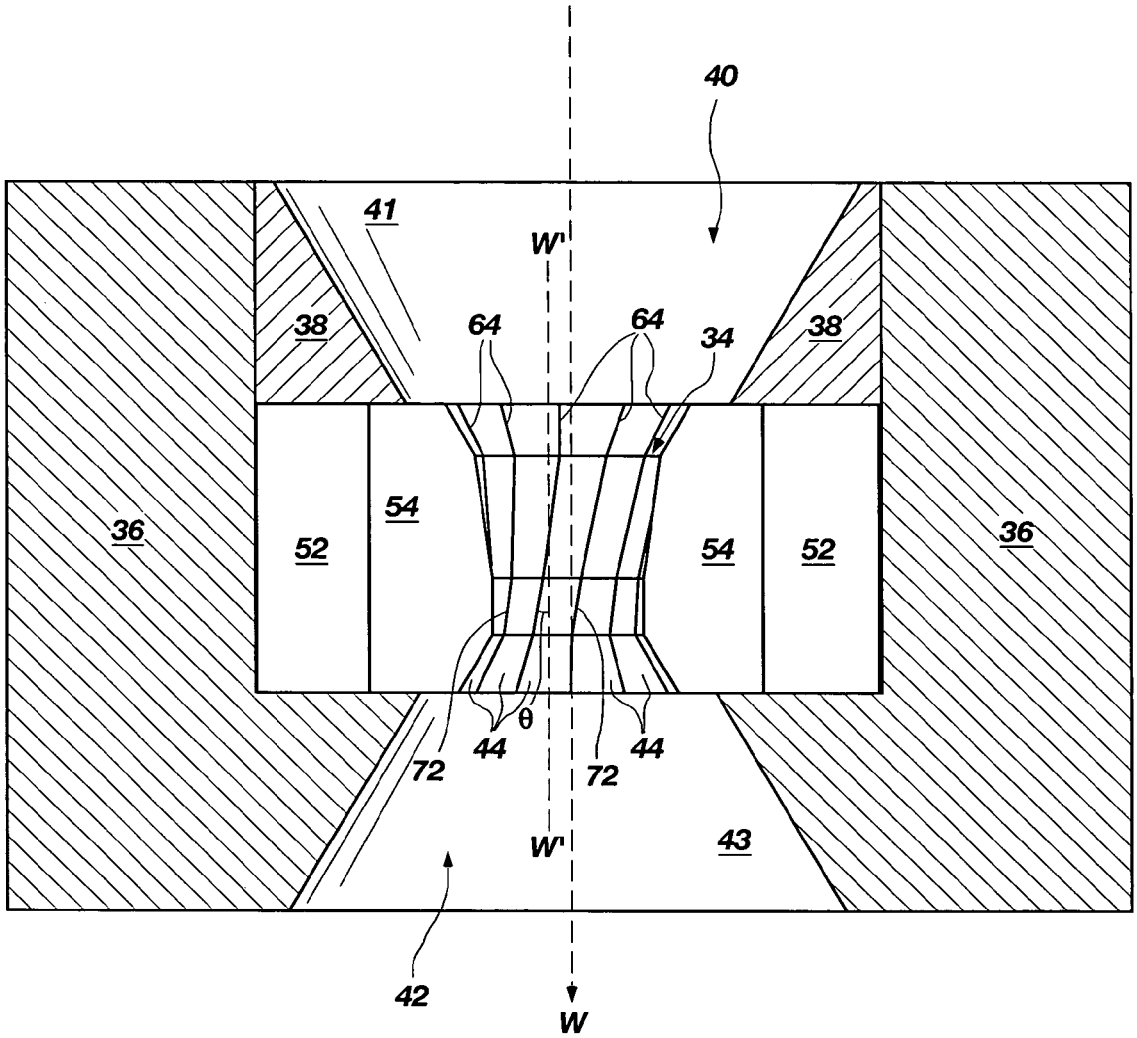
FIG. 6 is a side cross-sectional isometric view of a wire-drawing die assembly in accordance with another embodiment of the present invention.
Figure 7A:
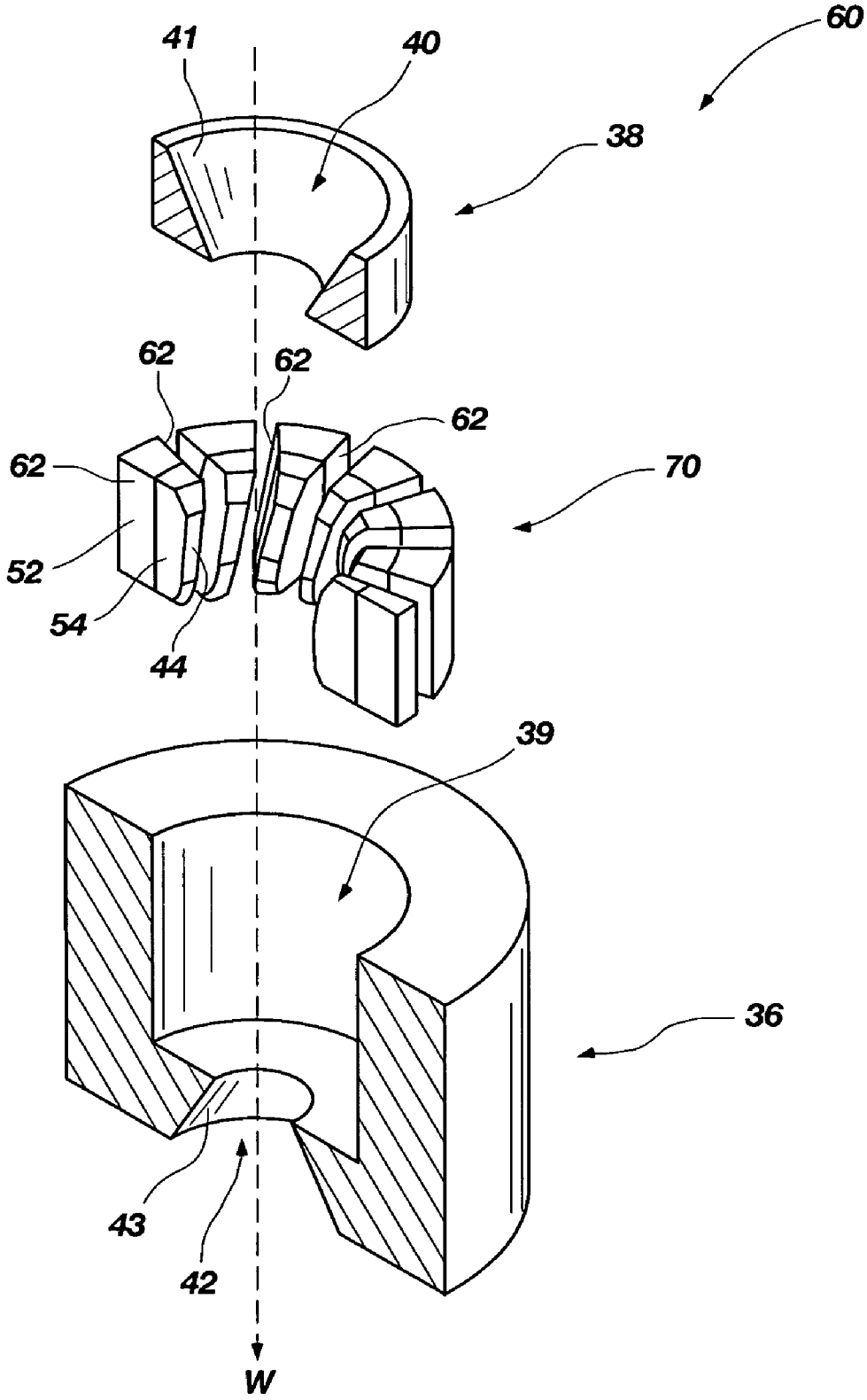
FIG. 7A is an exploded, cross-sectional isometric view of the wire-drawing die assembly shown in FIG. 6.
Figure 7B:
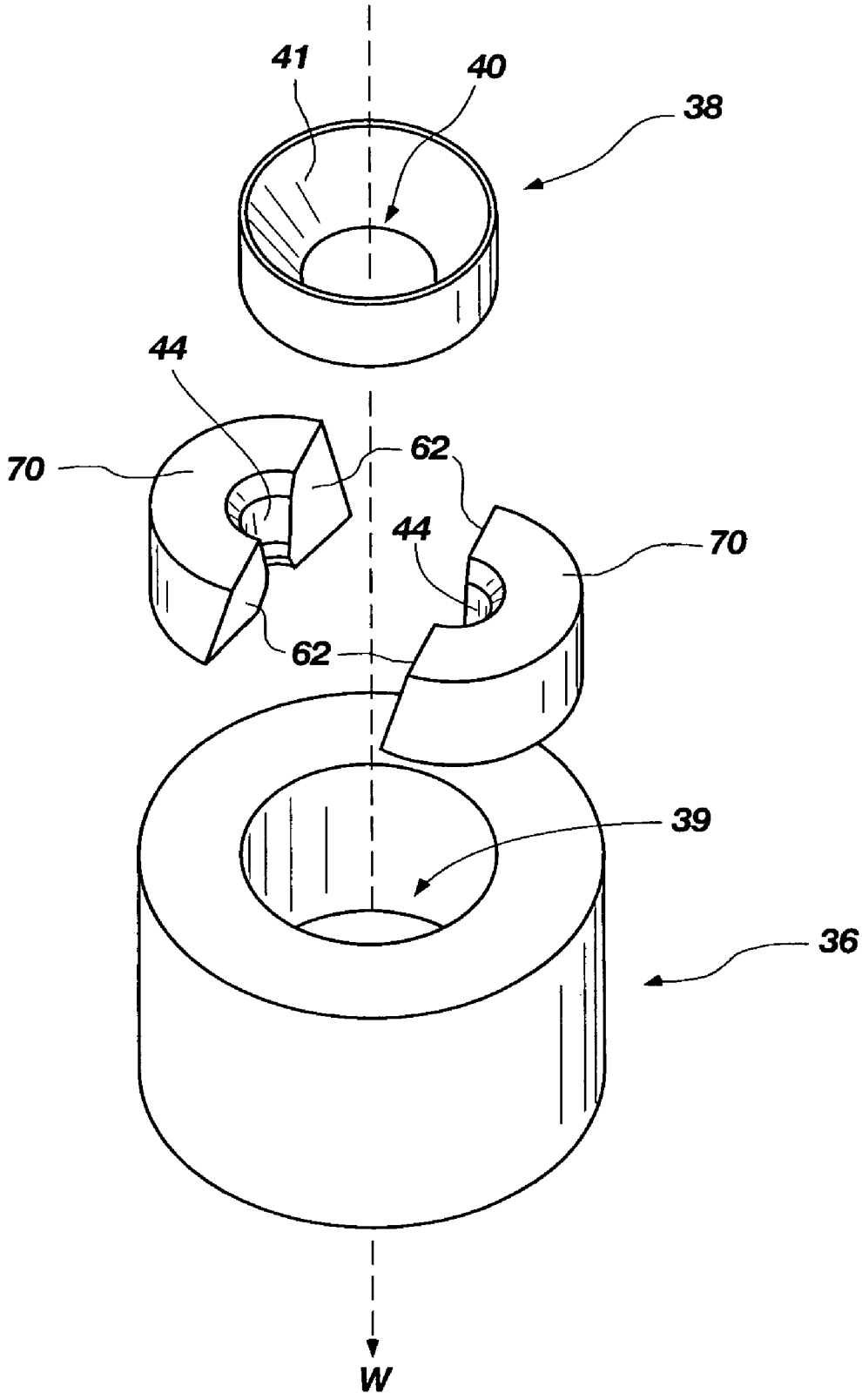
FIG. 7B is an exploded, isometric view of a wire-drawing die assembly having only two die segments in accordance with another embodiment of the present invention.
Figure 8:
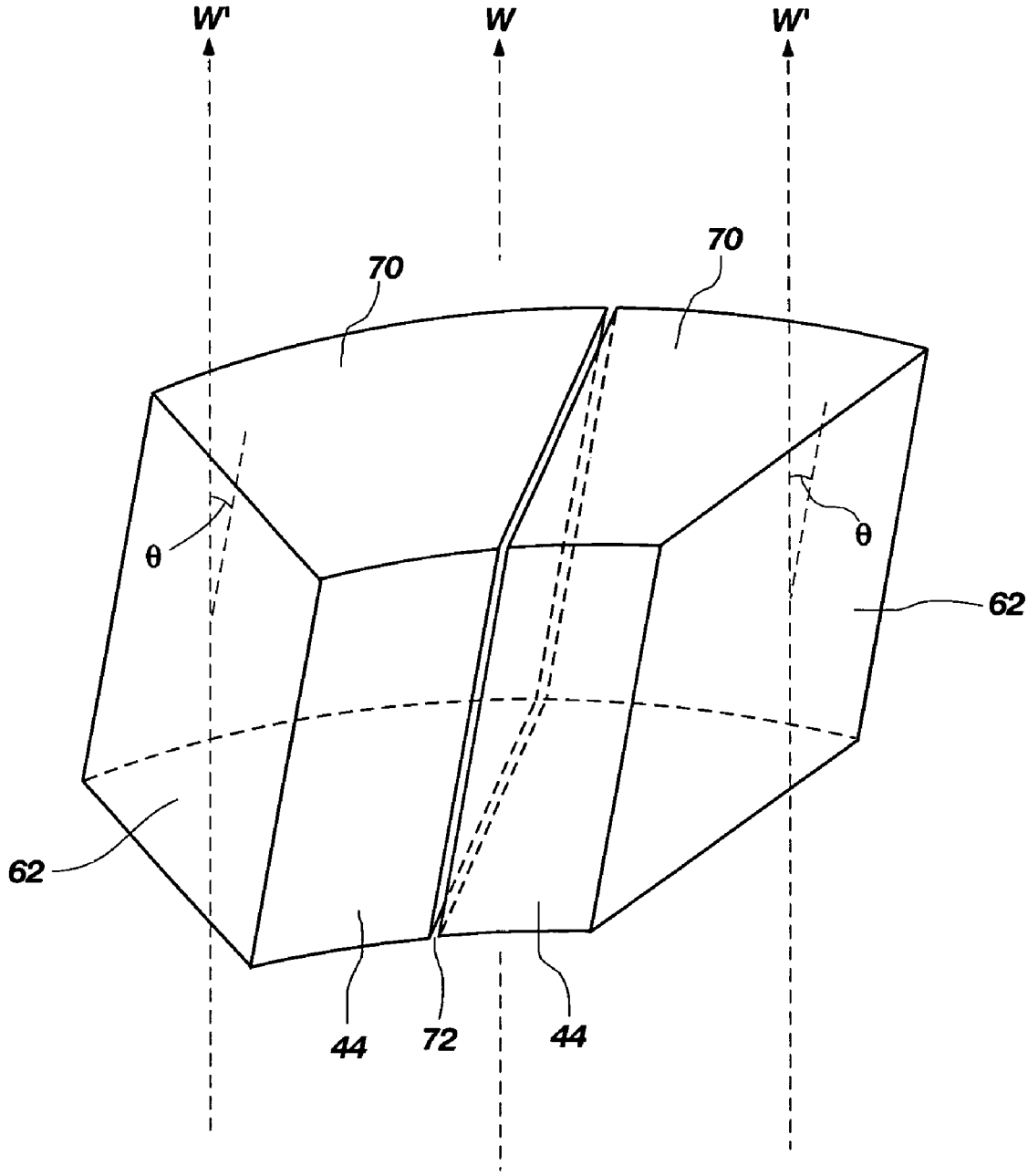
FIG. 8 is a partial, isometric view of two adjacent assembled die segments of the wire-drawing die assembly shown in FIGS. 6 and 7 illustrating the angle that the sidewalls of each of the die segments forms with the wire-drawing axis.

As shown in FIG. 2, the sidewalls 45 of each of the die segments 32 are oriented generally parallel to the wire-drawing axis W. As the wire or wire bundle 56 is drawn through the wire-drawing die assembly 30, seams 58 between adjacent die segments 32 may form longitudinal striations (e.g., generally aligned with the wire-drawing axis W) on the wire or wire bundle 56 drawn through the die cavity 34. FIGS. 6 through 8 show a wire-drawing die assembly 60 in accordance with another embodiment of the present invention that allows for multiple die segments to be used without forming longitudinal striations on the drawn wire or wire bundle 56. The wire-drawing die assembly 60 may be used when the quality of the surface finish of the wire or wire bundle is more of a concern.

The wire-drawing die assembly 60 includes die segments 70 that are configured differently than the die segments 32 shown in FIGS. 2 through 5. Each of the die segments 70 include sidewalls 62, with the inner die surface 44 extending between the sidewalls 62. The sidewalls 62 are oriented at an angle θ (i.e., nonparallel) relative to the wire-drawing axis W. Although the wire-drawing die assembly 60 is illustrated in FIGS. 6 and 7A as having twelve die segments 70, in various other embodiments of the present invention, such as the embodiment shown in FIG. 7B, a wire-drawing die assembly may have at least two die segments 70.

FIGS. 6 and 8 show the relative orientation of the sidewalls 62 and the wire-drawing axis W. Particularly, if a reference axis W' is drawn parallel to the wire-drawing axis W so that it intersects the plane of the sidewall 62, the sidewall 62 is oriented at an angle θ (e.g., nonparallel) relative to the axis W'. Accordingly, as the wire or wire bundle 56 is drawn through the die cavity 34 of the wire-drawing mold assembly 60, seams 72 between adjacent die segments 70 may inhibit or prevent formation of longitudinal striations on the exterior of the wire or wire bundle 56. Since the seams 72 are oriented transversely about the wire or wire bundle 56, and any marking of the surface of the wire or wire bundle 56 by the seams 72 should be substantially uniform along the length and circumference of the wire or wire bundle 56. Accordingly, any marking of the surface of the wire or wire bundle 56 may not be visually apparent or otherwise significant.

Figure 9:
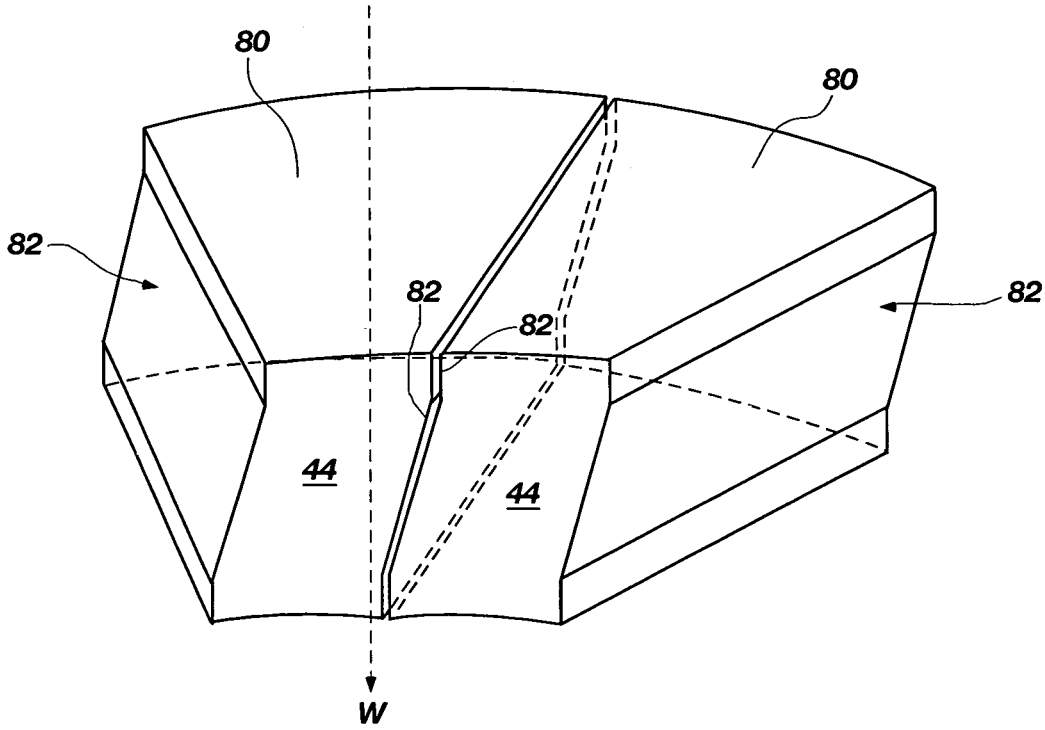
FIG. 9 is an isometric view of two adjacent assembled die segments of a wire-drawing die assembly with non-planar sidewalls in accordance with one embodiment of the present invention.
Figure 10:
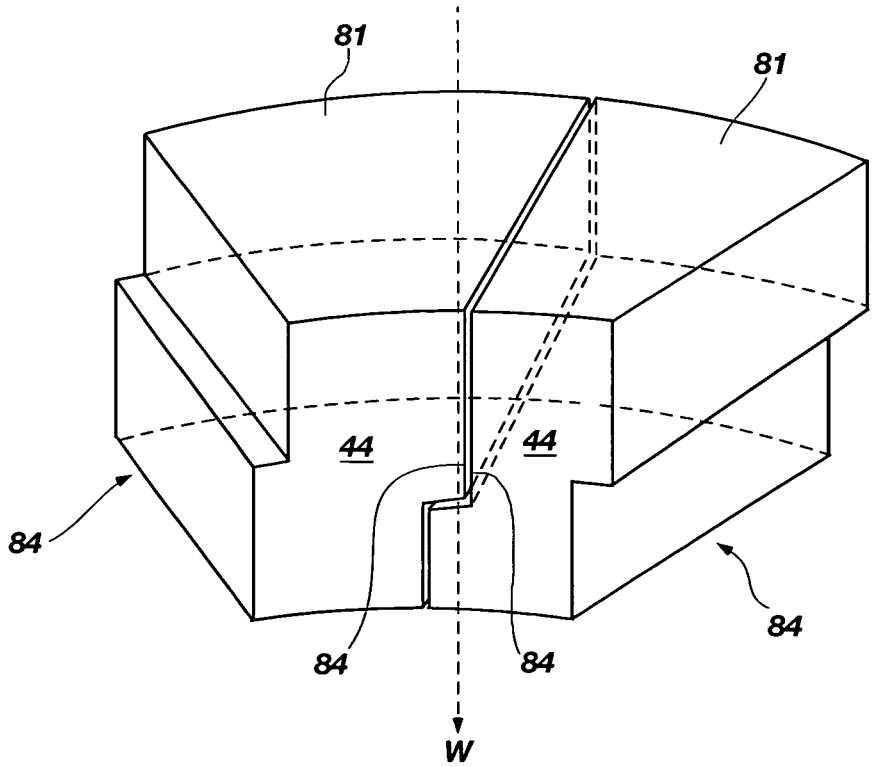
FIG. 10 is an isometric view of two adjacent assembled die segments of a wire-drawing die assembly with non-planar sidewalls in accordance with yet another embodiment of the present invention.

In the embodiment shown in FIGS. 6 through 8, the sidewalls 62 of the die segments 70 are generally planar. However, in other embodiments of the present invention, the sidewalls 62 may exhibit a variety of different nonplanar configurations. FIGS. 9 and 10 show embodiments of the present invention for nonplanar sidewall geometries. FIG. 9 shows die segments 80, each of which includes sidewalls 82 with the inner die surface 44 extending between the sidewalls 82. As shown in FIG. 9, the sidewalls 82 exhibit a nonplanar stepped or jogged geometry with at least a portion of the sidewalls 82 oriented at an angle θ relative to the wire-drawing axis W. FIG. 10 shows die segments 81, each of which includes sidewalls 84 with the inner die surface 44 extending between the sidewalls 84. As shown in FIG. 10, the sidewalls 84 also exhibit a nonplanar stepped or jogged geometry similar to the die segments 80 shown in FIG. 8 with at least a portion of the sidewalls 84 oriented at an angle θ relative to the wire-drawing axis W. In addition to the stepped or jogged geometry for the sidewalls 82 and 84, in other embodiments of the present invention, the sidewalls of the die segments may be concave, convex, helical, or any other configuration, without limitation. Such a configuration may alleviate forming longitudinal striations on the exterior of the wire or wire bundle 56 when the wire or wire bundle 56 is drawn through a die cavity and/or may facilitate interlocking and/or positioning adjacent die segments relative to one another.

Although several of the embodiments of the present invention have been illustrated with particular configurations for the housing 36 and the retention member 38, various other structures may be used to support the multiple die segments. For example, the multiple die segments may secured within the housing 36 by press-fitting, brazing, or another suitable attachment structure. Moreover, the housing 36 and the retention member 38 may be omitted and the multiple die segments may be assembled together and secured in place by a ring-shaped structure that extends about the assembly of multiple die segments.

The foregoing description, for purposes of explanation, used specific nomenclature to provide a thorough understanding of the present invention. However, it will be apparent to one skilled in the art that the specific details are not required in order to practice the present invention. The foregoing descriptions of specific embodiments of the present invention are presented for purpose of illustration and description. They are not intended to be exhaustive or to limit the invention to the precise forms disclosed. Obviously many modifications and variations are possible in view of the above teachings. The embodiments are shown and described in order to best explain the principles of the present invention and its practical applications, to thereby enable others skilled in the art to best utilize the invention and various embodiments with various modifications as are suited to the particular use contemplated. It is intended that the scope of the present invention be defined by the following claims and their equivalents. The words "including" and "having," as used herein, including the claims, shall have the same meaning as the word "comprising."

The invention claimed is:

1. A wire-drawing die assembly, comprising:

an assembly of at least three die segments, each of the at least three die segments including an inner die surface comprising a superhard polycrystalline material, the inner die surfaces of the at least three die segments forming a die cavity, a plurality of seams, each of the seams formed between adjacent ones of the inner die surfaces and partially defining the die cavity, at least a portion of each of the seams oriented at a non-zero angle relative to a wire-drawing axis of the die cavity and extending partially about the wire-drawing axis.

2. The wire-drawing die assembly of claim 1 wherein each of the at least three die segments comprises a substrate with the superhard polycrystalline material bonded to the substrate.

3. The wire-drawing die assembly of claim 2 wherein the superhard polycrystalline material comprises at least one of the following materials:

polycrystalline diamond;
polycrystalline cubic boron nitride;
silicon carbide; and
tungsten carbide.

4. The wire-drawing die assembly of claim 1 wherein the superhard polycrystalline material comprises at least one of the following materials:

polycrystalline diamond;
polycrystalline cubic boron nitride;
silicon carbide; and
tungsten carbide.

5. The wire-drawing die assembly of claim 1 wherein the at least three die segments are positioned circumferentially adjacent to one another about the die cavity.

6. The wire-drawing die assembly of claim 1 wherein each of the at least three die segments comprises two sidewalls with the inner die surface extending between the two sidewalls, wherein at least a portion of each of the two sidewalls is oriented nonparallel relative to a wire-drawing axis of the die cavity.

7. The wire-drawing die assembly of claim 6 wherein each of the two sidewalls exhibits one of a planar and nonplanar geometry.

8. The wire-drawing die assembly of claim 1 wherein each of the two sidewalls exhibits a jogged geometry.

9. The wire-drawing die assembly of claim 8 wherein each of the two sidewalls exhibits a nonplanar geometry.

10. The wire-drawing die assembly of claim 1 wherein the non-zero angle is selected so that when a wire is drawn through the die cavity, an exterior longitudinal striation is not formed on the wire.

11. A wire-drawing die assembly, comprising:

a plurality of die segments each of which includes an inner die surface comprising a superhard polycrystalline material, each of the plurality of die segments including two sidewalls with the inner die surface extending between the two sidewalls;

wherein the plurality of die segments are assembled so that the inner die surface of each of the plurality of die segments forms a portion of a die cavity, a plurality of seams, each of the seams formed between adjacent ones of the inner die surfaces and partially defining the die cavity, at least a portion of each of the seams oriented at a non-zero angle relative to a wire-drawing axis of the die cavity and extending partially about the wire-drawing axis; and wherein at least a portion of each of the two sidewalls is nonparallel relative to a wire-drawing axis of the die cavity.

12. The wire-drawing die assembly of claim 11 wherein each of the two sidewalls exhibits a planar geometry.

13. The wire-drawing die assembly of claim 11 wherein each of the two sidewalls exhibits a nonplanar geometry.

14. The wire-drawing die assembly of claim 13 wherein each of the two sidewalls exhibits a jogged geometry.

15. The wire-drawing die assembly of claim 13 wherein each of the two sidewalls exhibits a curved geometry.

16. The wire-drawing die assembly of claim 11 wherein the superhard polycrystalline material comprises at least one of the following materials polycrystalline diamond;

polycrystalline cubic boron nitride;
silicon carbide; and
tungsten carbide.

17. The wire-drawing die assembly of claim 11 wherein each of the die segments comprises a substrate bonded to the superhard polycrystalline material.

18. The wire-drawing die assembly of claim 17 wherein the superhard polycrystalline material comprises at least one of the following materials:

polycrystalline diamond;
polycrystalline cubic boron nitride;
silicon carbide; and
tungsten carbide.

19. The wire-drawing die assembly of claim 10 wherein the die segments are positioned circumferentially adjacent to one another about the die cavity.

20. The wire-drawing die assembly of claim 11 wherein the non-zero angle is selected so that when a wire is drawn through the die cavity, an exterior longitudinal striation is not formed on the wire.

21. A method of assembling a wire-drawing die assembly, comprising:

arranging at least three die segments to form a die cavity, each of the at least three die segments including an inner die surface comprising superhard polycrystalline material, a plurality of seams, each of the seams formed between adjacent ones of the inner die surfaces and partially defining the die cavity, at least a portion of each of the seams oriented at a non-zero angle relative to a wire-drawing axis of the die cavity and extending partially about the wire-drawing axis.

22. The method of claim 21, further comprising positioning the at least three die segments circumferentially adjacent to one another about the die cavity.

23. The method of claim 22:

wherein each of the die segments comprises two sidewalls with the inner die surface extending between the two sidewalls, the inner die surfaces forming the die cavity; and further comprising abutting each of the sidewalls of one die segment of the at least three die segments with another one of the sidewalls of another of the at least three die segments.

24. The method of claim 21 wherein the non-zero angle is selected so that when a wire is drawn through the die cavity, an exterior longitudinal striation is not formed on the wire.

* * * * *